United States Patent [19]

Wright

[11] 4,258,854

[45] Mar. 31, 1981

[54] BOTTLE FITMENT

[76] Inventor: Thomas E. Wright, 6340 Americana Dr., Clarendon Hills, Ill. 60514

[21] Appl. No.: 72,432

[22] Filed: Sep. 4, 1979

[51] Int. Cl.[3] ..... B65D 49/02

[52] U.S. Cl. ..... 215/21

[58] Field of Search ..... 215/21, 22, 23, 29, 215/26; 222/147

[56] References Cited

U.S. PATENT DOCUMENTS

| | | | |
|---|---|---|---|
| 845,136 | 2/1907 | Solomon | 215/21 |
| 1,161,328 | 11/1915 | Pavesi | 215/26 UX |
| 2,122,595 | 7/1938 | Stonebraker | 215/21 |
| 2,155,292 | 4/1939 | Baldwin | 215/22 |
| 4,043,473 | 8/1977 | Webb | 215/21 |

*Primary Examiner*—Donald F. Norton

[57] ABSTRACT

A bottle fitment is disclosed including a one-way valve which prevents re-filling of the bottle without visible damage to the fitment. The Bottle Fitment can be combined with a bottle cap for use in a bottle capping machine. The fitment also allows free flow of liquid from the neck of the bottle without an initial surge. The neck opening of the fitment includes a no-drip feature.

8 Claims, 7 Drawing Figures

BOTTLE FITMENT

BACKGROUND OF THE INVENTION:

The problem of initial surge of liquid from the neck of a bottle, especially a liquor bottle and that of the key problem of preventing the refilling of quality, high priced liquor bottles have attracted many solutions exhibiting varying degrees of success. It is estimated that the illegal refilling in pouring locations and homes of quality liquor bottles costs the distillers of quality liquor millions of dollars in deserved income each year. Through substitution, plus the absolute fact that the consumer is served a substitute in process, proving there is consumer fraud involved in every case. Although many devices or fitments have been developed to prevent deception through watering of liquor or illegal refilling of liquor bottles, few, if any, of these devices have experienced use or production for various reasons.

For instance, the Fisher U.S. Pat. No. 2,337,549 discloses a plastic-anti refill device which uses a ball that cooperates with a seat. The ball is carried in a cage formed by cementing multiple parts together. The body of the cage is provided with a set of thin-edged fins that engage the inside neck of the bottle.

The Fisher device can be pushed into the bottle for re-filling where it becomes visual evidence of such an act and any attempt to extract it from the neck of bottle results in its damage. Fisher solved the problem of making a device that can be used with different neck sizes of bottles and eliminates the necessity of using cement to hold the device in the neck of the bottle.

The particular problem of pilfering of liquor or re-filling a bottle with low quality, low cost substitute liquor after it is empty is attacked by Klewer in U.S. Pat. No. 2,800,239. Klewer provides a stopper with a metal tube having an outer cork mantle and an inner plastic mantle which forms one piece with a head-like upper part of the device that closes the upper end of the tube. Tenion-like projections connect the tube with the upper part or head and a disjunctive disc is provided between the cork mantle and the head, which disconnects the two parts upon extraction from the neck of a bottle. This makes it impossible to re-use the severed stopper. As long as the stopper remains unbroken, a purchaser can be assured that the bottle has its original contents.

Other patents (Musel U.S. Pat. No. 3,063,589, Webb U.S. Pat. No. 4,043,473; Hagen U.S. Pat. No. 3,263,849 and Miller U.S. Pat. No. 3,399,811) show various forms of non-refillable pouring spouts.

Close examination of some of these prior art devices reveals that it is possible for the unscrupulous to insert a long pin and hold the valve member in the open position so that low quality liquor or other liquid can be introduced into the neck of the bottle. Also in some of these devices, the means by which the initial surge of liquor through the device is inhibited does not always do the best job and spilling of the liquor results.

OBJECTIVE OF THE INVENTION

The primary object of this invention is to provide a fitment which overcomes these and related problems in this art.

SUMMARY OF THE INVENTION

This invention provides a fitment for a bottle that comprises three pieces, two of which snap-fit together to form a housing and valve seat for the third piece which serves as a floating or suspendable valve member. The housing is adapted to snap-fit into a bottle cap and be used in a bottle capping machine whereby both the fitment and the cap can be installed in the neck of the bottle during the initial filling of the bottle at the filling station of a bottling plant. The valve member is so shaped as to prevent unauthorized opening and also provides means whereby any attempt at unauthorized opening can be readily detected. A wafer thin or disjunctive connection is provided between the top and sides of the housing which will tear or separate when one attempts to remove the fitment.

DESCRIPTION OF THE DRAWINGS

Several embodiments of the invention are shown in the drawings wherein.

DESCRIPTION OF THE PREFERRED EMBODIMENT

Figure 1:
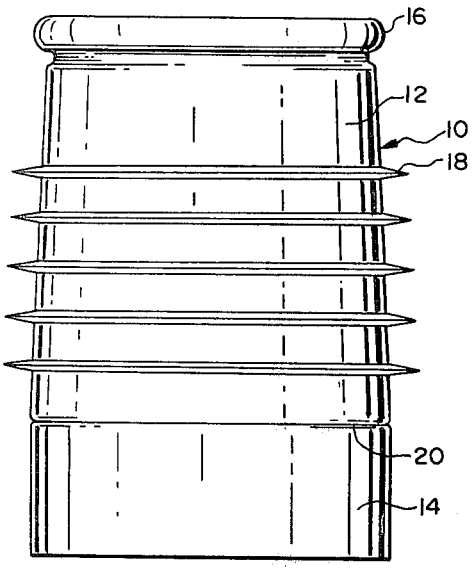
FIG. 1 is a side perspective view of the fitment of this invention.

Referring to the drawings particularly FIG. 1 the fitment 10 of the invention is shown to have a generally cylindrical body member 12 with a base or valve member 14. The body member 12 has a top rounded flange, circumferential flange or lip 16. The body portion 12 has a plurality of spaced thin fins 18 which extend circumferentially around the lower portion of the body. The juncture between the body member 12 and the base member 14 is illustrated at 20.

Figure 2:
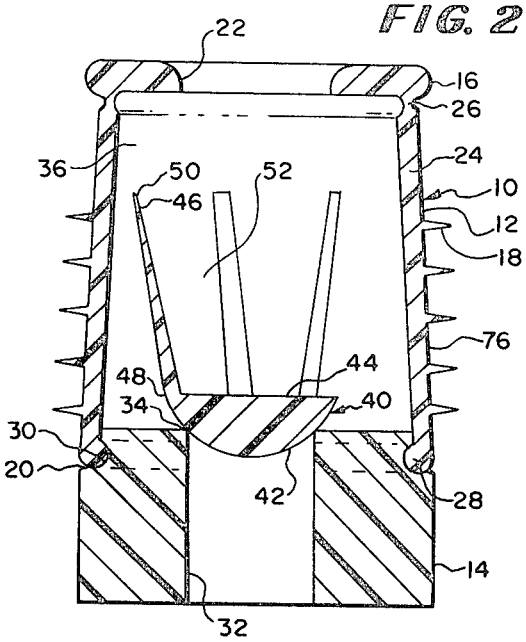
FIG. 2 is a cross-section of the fitment of this invention taken along the longitudinal axis of FIG. 1.

Referring to FIG. 2 it is seen that the fitment 10 defines a top opening 22 and that immediately below the flange or lip 16 the wall 24 of the top member 12 joins this flange at a thin walled juncture 26. This represents a weak point in the structure and any attempt to remove the fitment 10 from the neck of the bottle will result in a fracture of this juncture. The edge of the opening 22 flares outwardly so as to be drip-free.

FIG. 2 also shows that the bottom edge of the top portion 12 has an inwardly directed radially lip 28 which engages a corresponding groove 30 along the top edge of the base member 14. These parts join at the juncture line 20 also illustrated in FIG. 1.

The base member 14 defines the passageway 32 which is generally cylindrical and can be of any desired diameter, preferably as large as possible to provide maximum flow with any design of valve member (40) to be described.

The top peripheral edge 34 of the passageway 32 in the base 14 defines a valve seat. The top member 12 of the fitment 10 is generally cylindrical and hollow defining the large passageway 36.

The valve member 40 is contained within the passageway 36. This valve member has a semispherical base portion 42 and a flat top portion 44 with a plurality of vanes or arms 46 extending from the periphery 48 of the flat portion 44. The vanes 46 are relatively thin, may taper to a fine edge at 50 and are spaced, as illustrated at 52, between each pair to provide maximum flow through the passage way 36.

The semispherical valve surface 42 of the valve member 40 can be larger in diameter, about the same diameter or of less diameter than the passageway 32. Thus if the surface is of less diameter than the passgeway 32, the valve member 40 is able to close the passageway 42 and seal against the valve surface or seat 34 at any angle or fall within the passageway 36. By using a valve member (40) with a base 42 that is of lesser diameter than the passageway 32, the latter may not be closed entirely and the periphery 34 can come into contact with the outer surfaces of the vanes 46 in the "closed" valve position.

Figure 5:
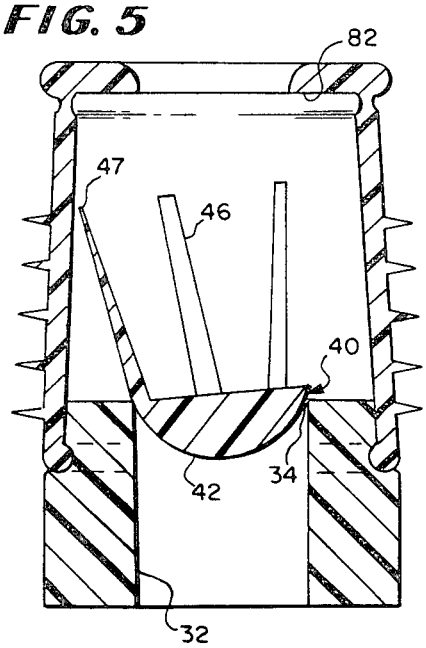
FIG. 5 is a perspective view of a modified form of valve member shown in a tilted position.

This is illustrated in FIG. 5 wherein the valve member 40 is about to fall against the valve seat 34 at an angle to the left (as viewed in FIG. 5), and be caught by contact of the vanes 46 on the edge 34. The valve surface 42 is extensive enough in all directions to at least effectively cover if not seal the valve surface 34. Complete closure of the passageway 32 is not always necessary. The primary purpose for having the valve member close the passageway is of course, to prevent anyone putting a hose into the passageway 32 for the purpose of siphoning out the contents. Secondly the presence of the valve member 40 in the passageway 32 reduces the extent of evaporation of the contents.

Figure 3:
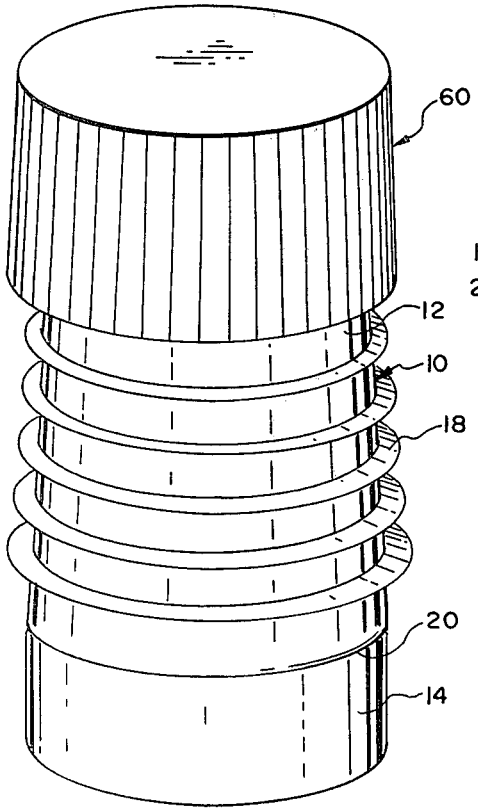
FIG. 3 is a perspective view of the fitment of this invention shown attached to the inside of a bottle cap in readiness for insertion into bottle neck after bottle has been filled with liquor on the fill line.

Referring briefly to FIG. 3 it is seen that the fitment 10 is provided with the bottle cap 60 and the body 12 extends from within the cap 60 exposing the fins 18 and the base 14. The assembly of FIG. 3, that is, the cap 60 and the fitment 10, can be fed through a bottle capping machine which upon forcing the assembly onto a bottle will produce the assembly shown in cross-section in FIG. 4. Here the cap member 60 has engaged the outer thread member 62 of the bottle neck 64 and has seated the fitment 12 at the lip 16 upon the upper edge 66 of the bottle neck. The inside top portion of the cap has a groove or offset 68, which engages in a snap-fit relationship with the outer flange or lips 16 of the fitment 10. The thin walled portion 26 is designed to withstand the removal and placement of the cap 60 on the rim 16 but is of such a strength that it will severe, if a prying action is used upon this rim. The severing of course, indicates an attempt to remove the fitment from the bottle.

Figure 4:
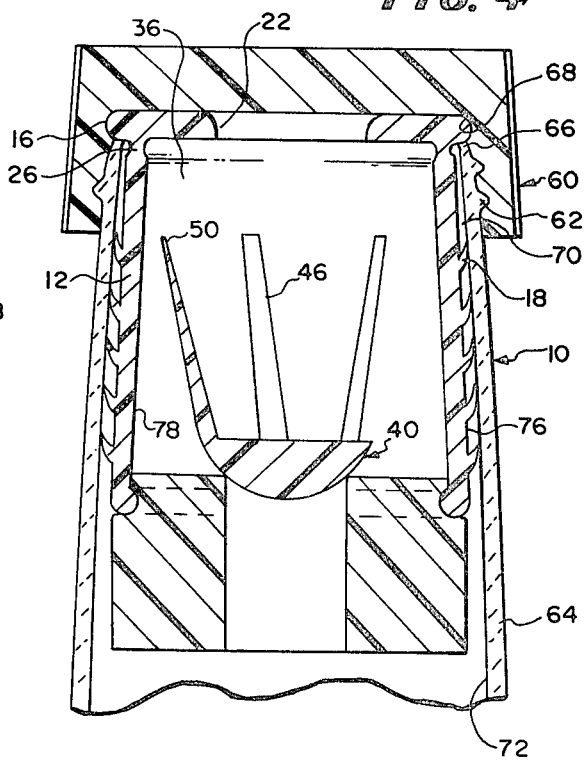
FIG. 4 is a cross section of the embodiment shown in FIG. 3 to show not only the attachment of the fitment to the inside of the bottle cap, but also the general arrangement of the internal valve member of the fitment.

FIG. 4 also illustrates how the fins 18 become wedged within the annular space 70 between the inner wall 72 of the neck 64 and the outer wall 76 of the fitment 10. One method of applying the fitment to the neck of the bottle is to warm the plastic so that it is plyable and as the bottle cap machine forces the fitment into the neck or into the space 70, the fins bend upwardly in conformity around the inside neck of the bottle. Upon cooling the fins set up and form a rigid connection, making it impossible to pull it out of the neck of the bottle whether formed of plastic or glass. The only way it can move is downwardly into the bottle depending on the radial over-lapping of the lip 16 and the top edge 66.

It is obvious that the valve member 40 could assume a canted position within the fitment wherein at least one of the ends 50 of the vanes 46 rests against the inner wall 78 of the passageway 36.

This aspect is shown in FIG. 5 wherein after the fitment 10 has been canted the valve member 40 may seat at an angle against the edge 34 and also has a base member 14 with a under passageway 32. This allows the edge 34 to engage against the outer surfaces of the vanes 46 when the fitment is in the upright position. Thus the surface 42 may or may not contact the periphery 34. And an exact seal is not formed at all times by the valve member 40 when it comes to rest on the periphery 34 as the bottle is placed in an upright position. Alternate constructions, not illustrated, would be to mold the surface 42 in an irregular shape or provide convolutions or notches in the periphery 34. These embodiments allow the use of a fitment with a larger diameter passageway 32 so that the dispensing of liquor is not impeded, except the initial surge.

Figure 6:
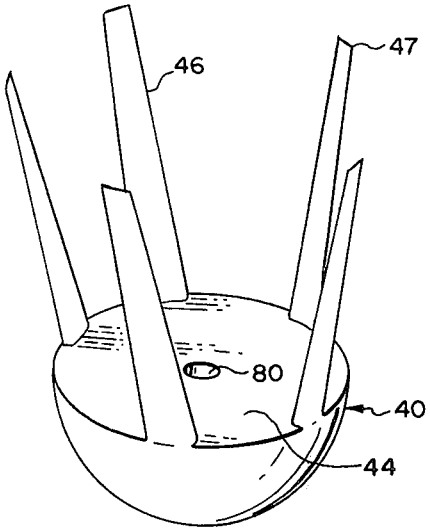
FIG. 6 is a perspective view of the modified form of valve member shown in FIG. 5
Figure 7:
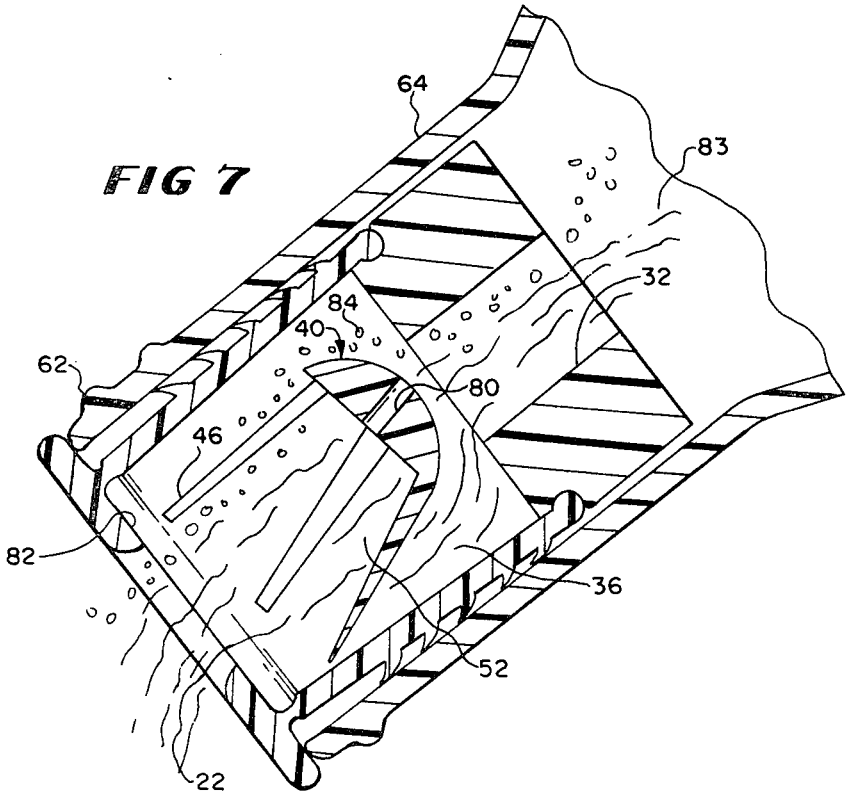
FIG. 7 is a cross-sectional view of the fitment of this invention shown during the dispensing of liquid therethrough.

FIG. 6 shows one form of valve member 40, in perspective, in this instance including a weep hole 80 at a substantially central location in body of the valve member. The weep hole 80 can allow the passage of vapor upwardly through the fitment and allow liquid to drain from the chamber 36 as desired. One or more holes 80 can be provided. Although a total of five vanes 46 are illustrated, the valve member 40 can be provided with as few as two such vanes and more than five vanes can also be used. The vanes fan outwardly so that the diameter of the array is greater at the top 47 than at the bases. The fins 46 can have any desired cross-sectional shape and are preferably about the same length. The array of vanes is such that the diameter at the tips 47 is greater than the diameter of the opening 22 but less than the diameter of the chamber 36. The end wall 82 of the body 12, defining the opening 22 catches the tips 47 as the out pouring liquid and incoming air pass through the fitment during the pouring operations as shown in FIG. 7.

The fitment of this invention can be formed using any of a wide variety of resinous materials. Generally the class of resins or plastics known as thermoplastics exhibit the desired processing, mechanical, thermal and resistance (chemical) characteristics that are suitable for the intended purpose. By using transparent plastics the tell-tale marks of any attempts to bypass the valve 40 may be made visible. The use of translucent or opaque plastics may be an advantage in that the internal structure is hidden from view.

Although the valve member 40 has been particularly described and illustrated, it is apparent that the body 42 need not be hemispherical nor must the top surface 44 be flat. The outer surface the body 42 can be convoluted or any irregular shape. The sealing function of the valve member must however be sufficient to allow only a small flow of liquid thereby so as to discourage refilling with cheaper liquors. Also the volumetric capacity of the chamber 36 is relatively small for this same purpose. The valve member has sufficient weight to orient itself on a generally axial relationship to the opening 36 guided by the tips 47. The surface 42 can either seat or seal against or within the passageway 32. Thus the largest diameter of the member 40 along the surface 44 can be less than the diameter of the passageway 32.

I claim:

1. An anti-refill fitment for the tubular outlet of a container comprising:

a tubular body member adapted to be sealed within said tubular outlet of said container;

a circumferential flange at one end of said body member defining a generally central outlet;

a base member associated with the other end of said tubular body member;

said base member defining an opening communicating with said container and having a valve seat opposed to and axially spaced from said central outlet;

said base member and body member having cooperating rib-groove means fitting together in a snap-fit relationship; and;

a valve member disposed between said central outlet and said opening;

said valve member adapted to seal against said valve seat in the upright position of said container and adapted to allow open communication from said container through said central outlet in the pouring position of said container.

2. An anti-refill fitment for a tubular outlet of a container comprising:

a tubular body member adapted to be sealed within said tubular outlet of said container;

a circumferential flange at one end of said body defining a generally central outlet;

said circumferential flange being joined to said body member along a frangible wall portion, whereby any attempt to dislodge said fitment from said container results in exposed, damaged portions;

a base member associated with the other end of said tubular body;

said base member defining an opening communicating said container and having a valve seat opposed to and axially spaced from said central outlet; and a valve member disposed between said central outlet and said opening;

said valve member adapted to seal against said valve seat in the upright position of said container and adapted to allow open communication from said container through said central outlet in the pouring position of said container.

3. An anti-refill fitment for a tubular outlet of a container comprising:

a tubular body member adapted to be sealed within said tubular outlet of said container;

a circumferential flange at one end of said body defining a generally central outlet;

a base member associated with the other end of said tubular body;

said base member defining an opening communicating with said container and having a valve seat opposed to and axially spaced from said central outlet;

a valve member disposed between said central outlet and said opening;

said valve member adapted to seal against said valve seat in the upright position of said container and adapted to allow open communication from said container through said central outlet in the pouring position of said container; and said valve member having a plurality of spine-like integral divergent members extending from the other side of said valve member toward said central outlet, whereby the ends of said spine members contact the periphery of said central outlet against said circumferential flange in the pouring position of said container and define plural liquid paths between the individual spine-like members communicating with said central outlet in the pouring position and thereby prevent the surging of said liquid therefrom.

4. An anti-refill fitment for a tubular outlet of a container comprising:

a tubular body member adapted to be sealed within said tubular outlet of said container;

a circumferential flange at one end of said body defining a generally central outlet;

a base member associated with the other end of said tubular body;

said base member defining an opening communicating with said container and having a valve seat opposed to and axially spaced from said central outlet;

a valve member disposed between said central outlet and said opening;

said valve member adapted to seal against said valve seat in the upright position of said container and adapted to allow open communication from said container through said central outlet in the pouring position of said container: and a frangible connection is provided between the top edge of said tubular body and said circumferential flange which will tear or separate exposing the consumer fraud when an unscrupulous person attempts to remove said fitment.

5. An anti-refill fitment for a tubular outlet of a container comprising:

a tubular body member adapted to be sealed within said tubular outlet of said container;

a circumferential flange at one end of said body defining a generally central outlet;

said circumferential flange being joined to said body member along a frangible wall portion, whereby any attempt to dislodge said fitment from said container results in exposed, damaged portions;

a base member associated with the other end of said tubular body;

said base member defining an opening communicating with said container and having a valve seat opposed to and axially spaced from said central outlet;

a valve member disposed between said central outlet and said opening;

said valve member adapted to seal against said valve seat in the upright position of said container and adapted to allow open communication from said container through said central outlet in the pouring position of said container; and said fitment including a cap member in which said circumferential flange snap fits into said cap member.

6. An anti-refill fitment for the tubular opening of a container comprising:

a tubular body member adapted to fit within the tubular opening of a container in sealed relationship;

a circumferential flange at one end of said body member, said flange having an outer portion adapted to engage against the top edge of said tubular opening and having an inner portion defining a generally central outlet;

a base member associated with the other end of said tubular body;

said base member defining an opening communicating with said container and having a valve seat opposed to and axially spaced from said inner portion of said flange and said central outlet;

said base member and body member having cooperating rib-groove means fitting together in a snap-fit relationship;

a valve member disposed between said central outlet and opening;

said valve member adapted to seat against said valve seat in the upright position of said container and adapted to allow open communication through said tubular body in the pouring position of said container and;

said tubular body member having a circumferential frangible wall portion, whereby an attempt to dislodge said fitment by prying against said outer portion of said tubular body member will produce a revealing separation at said frangible wall portion.

7. The combination of an anti-refill fitment and a cap member for the tubular neck and opening of a container, said fitment comprising a tubular body member adapted to fit within the tubular opening of said container in sealed relationship;

a circumferential flange at one end of said body member, said flange having an outer portion adapted to engage against the top edge of said tubular opening and having an inner portion defining a generally central outlet.

a base member defining an opening communicating with said container and having a valve seat opposed to and axially spaced from said inner portion of said flange and said central outlet;

a valve member disposed between said central outlet and said opening and adapted to seat against said valve seat in the upright position of said container and adapted to allow open communication through said tubular body in the pouring position of said container and;

said cap member having a threaded recess releasably engagable in sealed relationship over said circumferential flange and said tubular neck of said container.

8. An anti-refill fitment for the tubular opening of a container comprising:

a tubular body member adapted to fit within the tubular opening of a container in sealed relationship;

a circumferential flange at one end of said body member said flange having an outer portion adapted to engage against the top edge of said tubular opening and having an inner portion defining a generally central outlet;

a base member associated with the other end of said tubular body said base member defining an opening communicating with said container and having a valve seat opposed to and axially spaced from said inner portion of said flange and said central outlet;

said base member and body member having cooperating rib-groove means fitting together in a snap-fit relationship;

a valve member disposed between said central outlet and opening;

said valve member adapted to seat against said valve seat in the upright position of said container and adapted to allow open communication through said tubular body in the pouring position of said container and;

said tubular body member having at least one external circumferential fin of a diameter greater than the inside diameter of said tubular outlet; said tubular body and fin being heat deformable whereby the fitment upon being inserted into the tubular outlet of said container in heated condition yields to contact with the inside of said tubular outlet and upon cooling is sealed therein.

* * * * *